US006260612B1

(12) United States Patent
Nakamura et al.

(10) Patent No.: US 6,260,612 B1
(45) Date of Patent: Jul. 17, 2001

(54) "STACKED" TYPE HEAT EXCHANGER

(75) Inventors: Youichi Nakamura; Kimiaki Nakano, both of Hadano (JP)

(73) Assignee: Toyo Radiator Co., Ltd., Tokyo (JP)

( * ) Notice: Subject to any disclaimer, the term of this patent is extended or adjusted under 35 U.S.C. 154(b) by 0 days.

(21) Appl. No.: 09/571,860

(22) Filed: May 16, 2000

(30) Foreign Application Priority Data

May 20, 1999 (JP) ..... 11-139923

(51) Int. Cl.[7] ..... F28D 1/03; F28F 3/00

(52) U.S. Cl. ..... 165/82; 165/81; 165/149; 165/153; 165/167

(58) Field of Search ..... 165/81, 82, 167, 165/153, 149, 906

(56) References Cited

U.S. PATENT DOCUMENTS 4,917,181 * 4/1990 Kiernan, Jr. et al. ..... 165/81 X
5,186,239 * 2/1993 Young et al. ..... 165/81
5,582,241 * 12/1996 Yoho et al. ..... 165/81
5,584,340 * 12/1996 Derosier ..... 165/82

FOREIGN PATENT DOCUMENTS

3408867 * 9/1985 (DE) ..... 165/81
2-50088 * 2/1990 (JP) ..... 165/149

* cited by examiner

*Primary Examiner*—Leonard Leo
(74) *Attorney, Agent, or Firm*—Sughrue, Mion, Zinn, Macpeak & Seas, PLLC

(57) ABSTRACT

In a "stacked" type heat exchanger having a stack of elements through the interior of which a first fluid flows and having a core support arranged at the end of the stack in the stacked direction, the core support includes slits that extend from its edges up to the central portion, the slits capable of slightly deforming when subjected to a thermal stress. It is thus possible to reduce the thermal stress which may be applied to both the core support and the elements when there arises a difference of thermal expansion therebetween.

4 Claims, 2 Drawing Sheets

"STACKED" TYPE HEAT EXCHANGER

BACKGROUND OF THE INVENTION

1. Field of the Invention

The present invention relates generally to a "stacked" type heat exchanger having a core consisting of a plurality elements and having a core support, and, more particularly, to a "stacked" type heat exchanger having a simple structure for absorbing or reducing a thermal stress that may be induced between the elements and the core support.

2. Description of the Related Arts

A "stacked" type heat exchanger comprises a core and a core support. The core is in the form of a stack of elements, each element consisting of a pair of dish-like plates that are placed one on top of the other, each plate having communication apertures formed at opposed ends thereof. The pair of plates are joined together at their peripheries in a liquidtight fashion to form an element, and a plurality of elements are stacked in a liquidtight fashion by way of the communication apertures. The core support is joined to one end of the stack of the elements in the stacked direction. The core support has at its opposed ends a pair of port openings that are joined to the communication apertures in the elements in a liquidtight fashion. By way of example, a high-temperature fluid flows through the interior of the elements, and a cooling water is passed through the exterior of the elements.

Due to the presence of difference of temperature between a first fluid flowing through the interior of each element and a second fluid passing through the external surface of the core support, there may arise a difference of thermal expansion between the elements and the core support. This may possibly result in an occurrence of cracks at the peripheries of the commutation apertures that are junctions between the elements and the core support.

SUMMARY OF THE INVENTION

It is therefore the object of the present invention to provide a "stacked" type heat exchanger having a less tendency to cause any cracks.

According to a first aspect of the present invention there is provided a "stacked" type heat exchanger comprising a core including a plurality of elements, each of the plurality of elements consisting of a pair of plates, each of the plates having communication apertures formed at opposed ends in the longitudinal direction, at least one of the plates being shaped into a dish, the plates being placed one on top of the other with their peripheries being jointed together in a liquidtight fashion, the plurality of elements being joined together in a liquidtight fashion by way of the communication apertures at the opposed ends, to thereby form the core; and a planar core support adapted to be joined to one end of the core, the core support having a pair of port openings that are in alignment with the communication apertures at the opposed ends; wherein the core support includes a plurality of slits that are disposed between the pair of port openings so as to intersect an imaginary line joining the pair of port openings, the plurality of slits being slightly deformable when a thermal stress is applied to regions between the pair of port openings.

Each of the plurality of elements and the core support may have elongated planar surfaces. The plurality of slits may include a first slit formed in the core support so as to extend from one edge in its transverse direction up to a position beyond the central portion in the transverse direction of the core support; and a second slit formed in the core support so as to extend from the other edge in its transverse direction up to a position beyond the central portion in the transverse direction of the core support.

The plurality of slits may include a pair of arcuate edge slits formed circumferentially around the port opening in the elongated core support, the pair of edge slits extending from adjacent edges of the core support toward each other; and an arcuate central slit formed concentrically with respect to the pair of edge slits, but with a slight radially inward offset relative to the pair of edge slits, the central slit having opposed ends that extend up to the vicinity of the adjacent edges.

The plurality of slits further may includes a pair of auxiliary edge slits extending from the adjacent edges concentrically with respect to the central slit, but positioned radially opposite to the pair of edge slits with respect to the central slit.

The above and other objects, aspects, features and advantages of the present invention will become more apparent from the following detailed description when read in conjunction with the accompanying drawings, in which:

DESCRIPTION OF THE PREFERRED EMBODIMENTS

The present invention will now be described with reference to the accompanying drawings which illustrate preferred embodiments thereof in a non-limitative manner.

Figure 1:
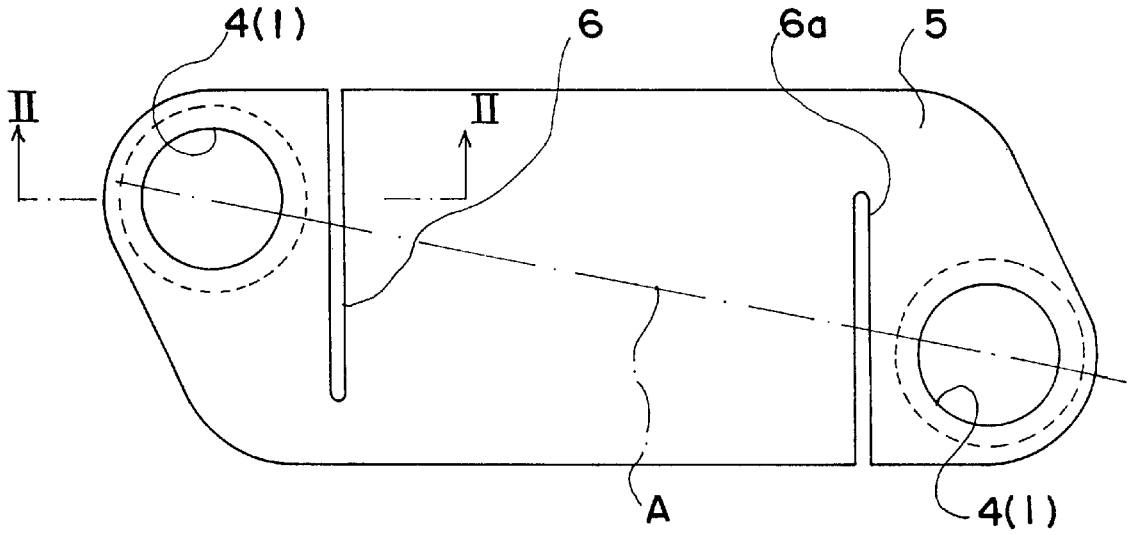
FIG. 1 is a top plan view of a "stacked" type heat exchanger in accordance with a first embodiment of the present invention.
Figure 2:
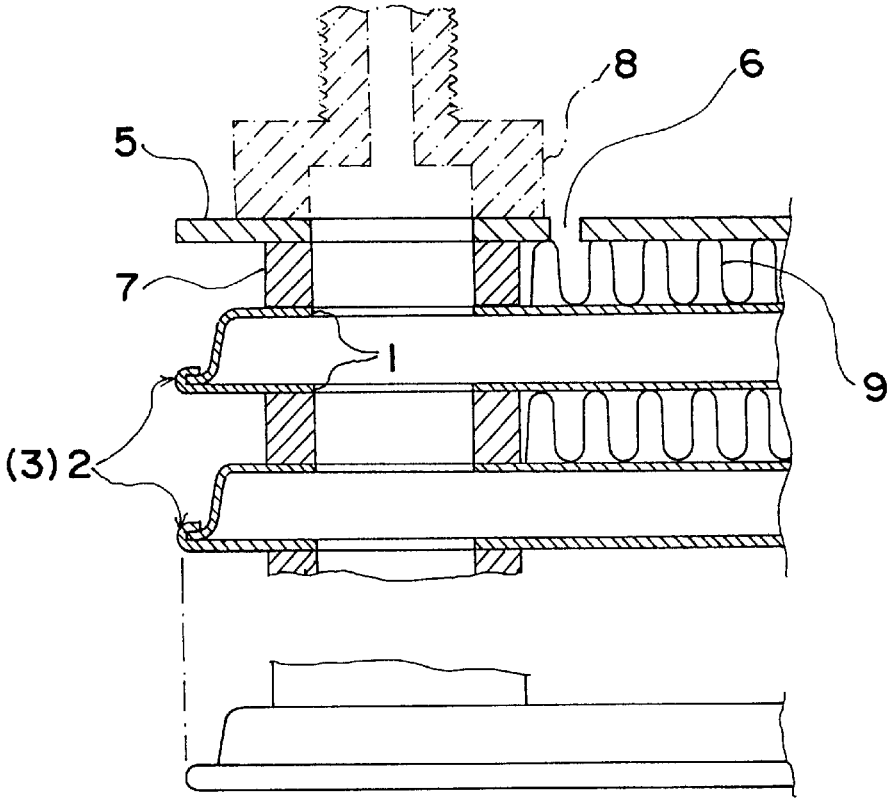
FIG. 2 is a schematic sectional view taken along a line II—II of FIG. 1 and viewed from the direction of the arrow.
Figure 3:
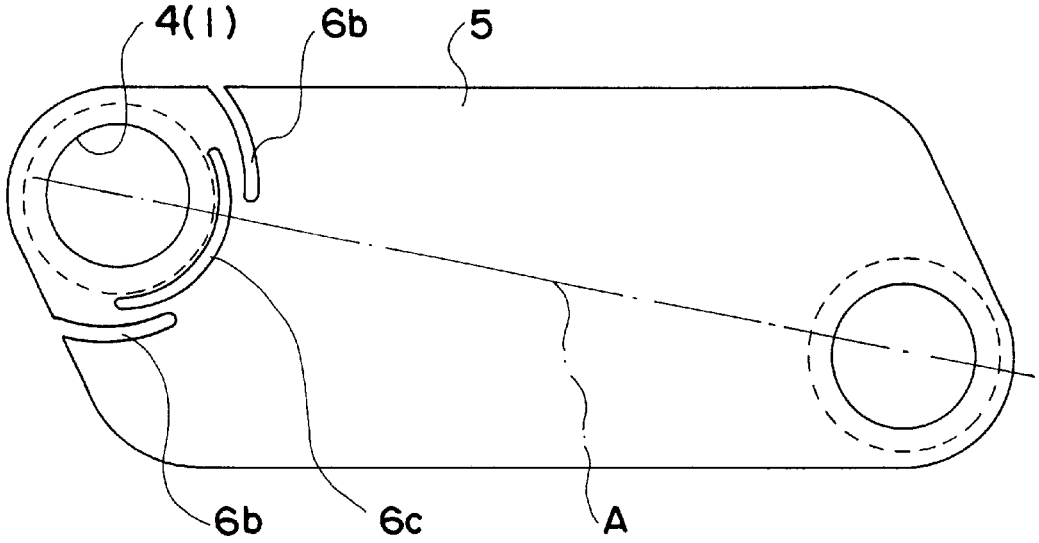
FIG. 3 is a top plan view of a second embodiment of the "stacked" type heat exchanger.
Figure 4:
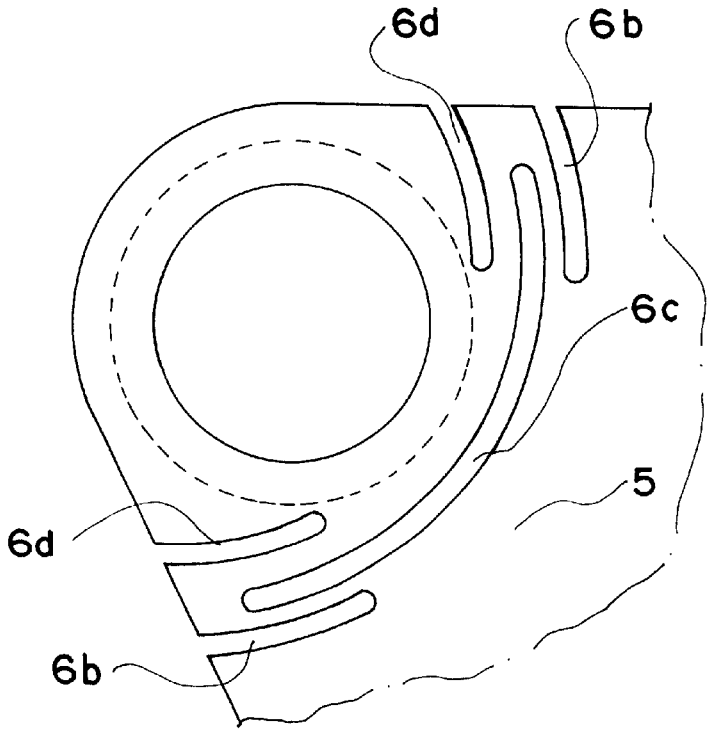
FIG. 4 is a top plan view of the major part of a third embodiment of the "stacked" type heat exchanger.

FIG. 1 is a top plan view of a "stacked" type heat exchanger in accordance with a first embodiment of the present invention, and FIG. 2 is a schematic sectional view taken along the line II—II of FIG. 1 and viewed from the direction of the arrow. FIG. 3 is a top plan view of a second embodiment of the present invention, and FIG. 4 is a top plan view of the major part of a third embodiment thereof.

The "stacked" type heat exchanger shown in FIGS. 1 and 2 comprises a multiplicity of elements 2, a multiplicity of annular spacers 7 interposed between the elements 2, and a core support 5 disposed at one end in the stacked direction. The element 2 consists of a pair of elongated plates each having communication apertures 1 formed at its opposed ends in the longitudinal direction, at least one of the plates being shaped into a dish, the pair of plates being placed one on top of the other, with their peripheral portions being joined together in a liquidtight fashion. The element 2 has a contour similar to that of the core support 5 of FIG. 1. The adjacent elements 2 are joined together in a liquidtight fashion at the communication apertures 1 by way of the annular spacers 7, with outer fins 9 being interposed between the external surfaces of the elements 2.

It is to be noted that no communication apertures are provided in the lower plate of the element 2 located at the lowermost end in the stacked direction. Alternatively, use maybe made of the lower plate having the communication apertures that are closed by end plates.

At the uppermost end in the stacked direction, the core support 5 is placed by way of the spacers 7. As shown in FIG. 1, the core support 5 has at opposed ends in its longitudinal direction a pair of port openings 4 that are in alignment with the communication apertures 1. The core support 5 has a thickness which is typically greater than that of each place of the elements 2. The core support 5 is provided with first and second slits 6 and 6*a* that are positioned in proximity to the port openings 4 associated therewith. More specifically, the first slit 6 near the port opening 4 on one hand extends from one edge in the transverse direction to the vicinity of the other edge, and the second slit 6 near the port opening 4 on the other extends from the other edge in the transverse direction to the vicinity of the one edge. The slits 6 and 6*a* intersect an imaginary line A joining the centers of the pair of port openings 4 and are arranged symmetrically with respect to the center of each element.

As shown in FIG. 2, a boss 8 is joined to the opening edge of the port openings 4 of the core support 5, with a piping not shown being connected to the fore-end of the boss 8. Then, a high-temperature fluid flows through the boss 8 on one hand into each element 2 and communicates through the interior of each element 2 in the longitudinal direction, after which it exits the heat exchanger through the boss on the other not shown. Cooling water is passed through the external surfaces of each element 2, the outer fins 9 and the external surface of the core support 5 to thereby cool the high-temperature fluid lying within each element 2.

At that time, the thermal expansion of the elements 2 is greater than that of the core support 5, giving rise to a thermal stress therebetween. The thermal stress causes the slits 6 to deform toward the extension to thereby absorb the difference of thermal expansion between the elements 2 and the core support 5. Thus, as compared with the case of absence of the slits, the opening edges of the communication apertures 1 of each element 2 are subjected to a restricted thermal stress.

Referring then to FIG. 3 there is shown the second embodiment having, along the opening edge of the port opening 4 on one hand, a pair of edge slits 6*b* extending arcuately from the adjacent edges and a single central slit 6*c* positioned inside of the pair of edge slits 6*b*.

The central slit 6*c* is in the shape of an arc and has opposed ends that terminate short of the edges of the core support 5. The edge slits 6*b* are arranged radially outside of the slit 6*c* and each have an open end on one hand and a closed end on the other that extends up to the vicinity of the middle of slit 6*c*.

Referring then to FIG. 4 there is depicted the third embodiment further having, in addition to the features of the FIG. 3 embodiment, a pair of auxiliary edge slits 6*d* arranged radially inside of the central slit 6*c* and extending arcuately from the adjacent edges.

The FIG. 4 embodiment reduces the rigidity of the core support 5 itself to facilitate the slit deformation induced by the thermal stress.

The "stacked" type heat exchanger as defined in claim 1 enables the difference of thermal expansion between the elements 2 and the core support 5, attributable to the difference of temperature between the fluid passing through the interior of the elements 2 and the fluid passing through the external surface of the core support 5, to easily be absorbed by the slits 6 formed in the core support 5. It is therefore possible to minimize the thermal stress applied to the communication apertures 1 in the elements 2 to thereby prevent any possible cracks, thus providing a "stacked" type heat exchanger having an extended service life.

According to the invention as recited in claim 2, the entire core support 5 can deform in a well-balanced manner when a thermal stress is applied thereto, by virtue of the first slit 6 formed in the core support 5 so as to extend from one edge in the transverse direction and by virtue of the second slit 6*a* formed in the core support 5 so as to extend from the other edge in the transverse direction. A highly reliable "stacked" type heat exchanger can thus be provided.

The "stacked" type heat exchanger as defined in claim 3 allows the core support 5 to be deformed easier, when subjected to a thermal stress, by the provision of the pair of arcuate edge slits 6*b* and the arcuate central slit 6*c*, to thereby ensure a well-balanced deformation of the core support 5.

According to the invention as recited in claim 4, an even easier thermal stress-induced deformation can be achieved.

While illustrative and presently preferred embodiments of the present invention have been described in detail herein, it is to be understood that the inventive concepts may be otherwise variously embodied and employed and that the appended claims are intended to be construed to include such variations except insofar as limited by the prior art.

What is claimed is:

1. A "stacked" type heat exchanger comprising:

a core including a plurality of elements, each of said plurality of elements consisting of a pair of plates, each of said plates having communication apertures formed at opposed ends in the longitudinal direction, at least one of said plates being shaped into a dish, said plates being placed one on top of the other with their peripheries being jointed together in a liquidtight fashion, said plurality of elements being joined together in a liquidtight fashion by way of said communication apertures at said opposed ends, to thereby form said core; and a planar core support adapted to be joined to one end of said core, said core support having a pair of port openings that are in alignment with said communication apertures at said opposed ends; wherein said core support includes a plurality of slits that are disposed between said pair of port openings so as to intersect an imaginary line joining said pair of port openings, said plurality of slits being slightly deformable when a thermal stress is applied to regions between said pair of port openings.

2. A "stacked" type heat exchanger according to claim 1, wherein each of said plurality of elements and said core support have elongated planar surfaces, and wherein said plurality of slits include:

a first slit formed in said core support so as to extend from one edge in its transverse direction up to a position beyond the central portion in the transverse direction of said core support; and a second slit formed in said core support so as to extend from the other edge in its transverse direction up to a position beyond the central portion in the transverse direction of said core support.

3. A "stacked" type heat exchanger according to claim 1, wherein said plurality of slits include:

a pair of arcuate edge slits formed circumferentially around said port opening in said elongated core support, said pair of edge slits extending from adjacent edges of said core support toward each other; and an arcuate central slit formed concentrically with respect to said pair of edge slits, but with a slight radially inward offset relative to said pair of edge slits, said central slit having opposed ends that extend up to the vicinity of said adjacent edges.

4. A "stacked" type heat exchanger according to claim 3, wherein said plurality of slits further includes:

a pair of auxiliary edge slits extending from said adjacent edges concentrically with respect to said central slit, but positioned radially opposite to said pair of edge slits with respect to said central slit.

* * * * *